United States Patent [19]

Tomiati

[11] 4,095,710

[45] Jun. 20, 1978

[54] SUCKING TUBE IN COMBINATION WITH A CAN

[76] Inventor: Umberto Tomiati, Via D. Filippini, 19, Verona, Italy

[21] Appl. No.: 704,875

[22] Filed: Jul. 13, 1976

[30] Foreign Application Priority Data

Jul. 18, 1975 Italy ..... 25581/75

[51] Int. Cl.[2] ..... B65D 83/00

[52] U.S. Cl. ..... 220/90.2; 215/1 A

[58] Field of Search ..... 215/1 A, 229; 220/90.2; 229/75; 206/217, 218

[56] References Cited

U.S. PATENT DOCUMENTS

| | | | |
|---|---|---|---|
| 1,680,341 | 8/1928 | Rosenthal | 215/1 A UX |
| 2,395,734 | 2/1946 | Georgopoulos | 229/75 |
| 3,189,171 | 6/1965 | Miller | 229/75 X |
| 3,445,033 | 5/1969 | Sweet | 220/90.2 |
| 3,780,944 | 12/1973 | Zubalik | 220/90.2 X |

FOREIGN PATENT DOCUMENTS

| | | | |
|---|---|---|---|
| 1,130,524 | 10/1956 | France | 215/1 A |

*Primary Examiner*—Donald F. Norton

*Attorney, Agent, or Firm*—Guido Modiano; Albert Josif

[57] ABSTRACT

A sucking tube for beverage, comprising the tube wound up within an enclosure which is removably associated to the respective container.

The enclosure is heat sealed, glued or snap-engaged to the container.

1 Claim, 12 Drawing Figures

SUCKING TUBE IN COMBINATION WITH A CAN

BACKGROUND OF THE INVENTION

This invention relates to a beverage sucking tube for small bottles, cans, and similar drink containers.

It is generally known that, quite often, beverages are consumed directly from their containers through a small sucking tube or "straw," which is commonly supplied separately by the seller.

However, it often happens that the beverage consumer does not consume his drink at the seller's, but rather at places where glasses and sucking tubes are not readily available, thereby he is compelled to drink directly from the bottle neck or, if a can, from the hole uncovered by the tear-off closure, which is hardly convenient from the hygiene point of view and also, for obvious reasons, pretty dangerous.

It should be further noted that in the automatic drink bottle dispensers, considerable machine volume is devoted to the plastic glasses and their automatic dispensing apparatus.

SUMMARY OF THE INVENTION

It is accordingly a primary object of this invention to eliminate the drawbacks mentioned above by providing a sucking tube, particularly for small bottles, cans and similar beverage containers, which thanks to its being directly connected to the beverage container allows the consumer to drink his beverage at any place.

It is another object of the invention to provide a sucking tube which ensures maximum hygienic protection for what concerns the packaging thereof.

It is a further object of this invention to provide a sucking tube which is easy to manufacture and associate with a beverage container, using conventional machinery for the application of caps or for filling available cans with beverages.

Still another object of the invention is to provide a sucking tube which, when associated with the beverage container, creates no bulk or interference even in the automatic beverage dispensing machines.

These and other objects such as will become apparent hereinafter, are achieved by a sucking tube particularly for small bottles, cans and similar beverage containers, according to the invention, characterized in that is is wound up within an enclosure removably associated with the beverage container.

BRIEF DESCRIPTION OF THE DRAWINGS

Further features and advantages will be more apparent from the ensueing description of some preferred, though not exclusive embodiments, illustrated by way of example and not of limitation in the acompanying drawings, where.

DESCRIPTION OF THE PREFERRED EMBODIMENTS

Figure 1:
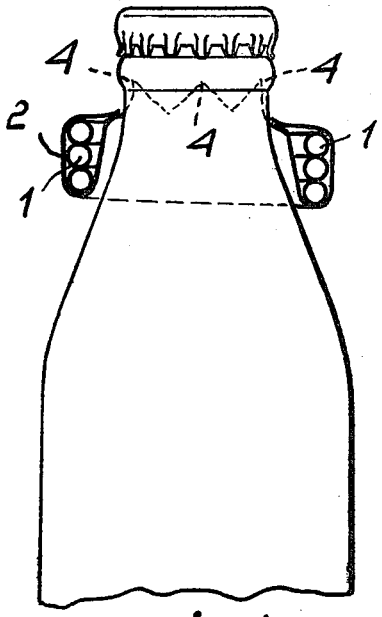
FIG. 1 shows a sucking tube associated with a small size bottle.
Figure 2:
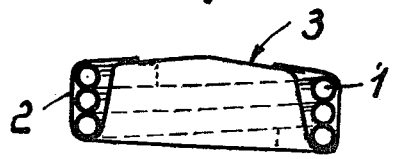
FIG. 2 is a sectional view through the sucking tube in its enclosure.
Figure 3:
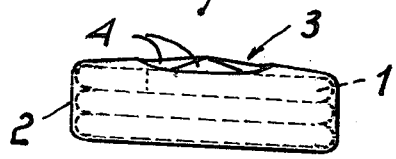
FIG. 3 is an elevational view of the enclosure whereinto the tube is inserted.
Figure 4:
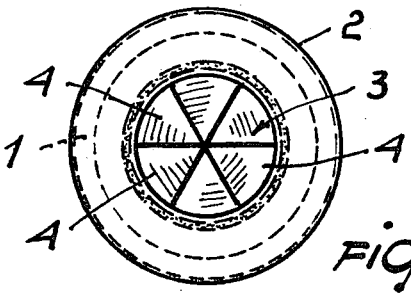
FIG. 4 is a plan view of the tube enclosure.
Figure 5:
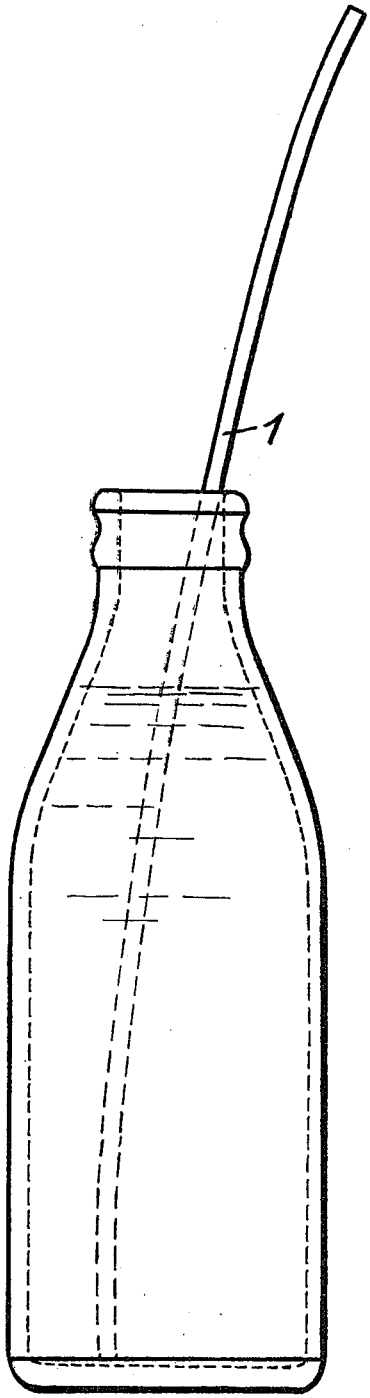
FIG. 5 shows a small bottle with the sucking tube according to the invention inserted thereinto.

With reference to FIGS. 1 to 5, the inventive sucking tube comprises a tube proper 1 wound up, preferably into a cylindrical coil, and enclosed within an enclosure 2 having a doughnut shape and formed essentially from the edge of a disc-like element 3 indented internally to the doughnut along radial directions such as to form triangular tabs 4.

The tube 1 is made in practice of a small plastic hose of a type approved for food containers, which has the important feature of returning to a substantially linear shape after the tube is removed from its enclosure.

Figure 6:
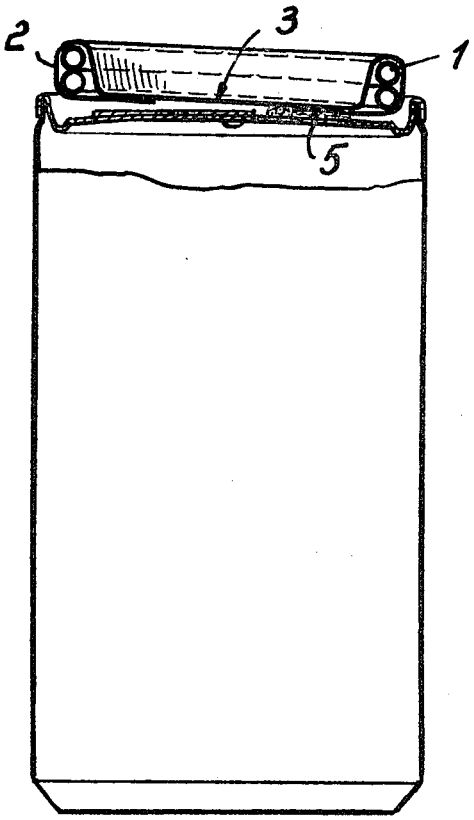
FIG. 6 is a partially cut away side view of the tube according to a second embodiment thereof, i.e. associated with a tear-off closure can.
Figure 7:
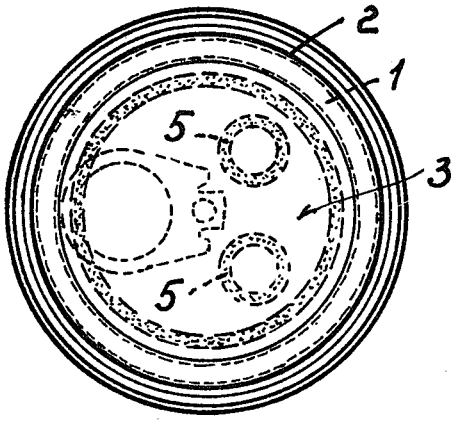
FIG. 7 is a plan view of the tube and related sleeve associated with a can.
Figure 8:
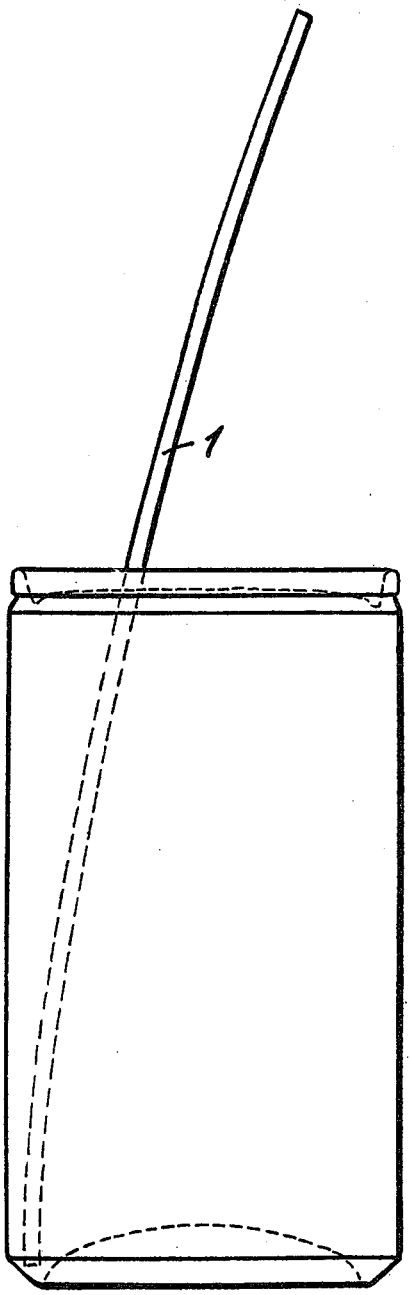
FIG. 8 depicts a can with the tube according to this invention inserted thereinto.

In a second embodiment (FIGS. 6 to 8), wherein like members are denoted with like numerals, the sucking tube according to this invention still comprises a tube 1 proper, wound up into a cylindrical coil, or possibly a flat spiral, and enclosed within an enclosure 2, again of doughnut-like shape, formed from the edges of a disc member 3, which in this instance is solid internally and affixed at two locations 5 to the can upper part.

Figure 9:
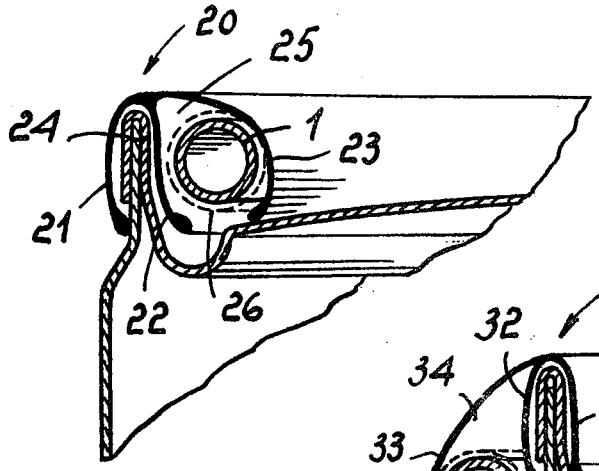
FIG. 9 shows a sectional view of a detail of a further embodiment of the enclosure for the application of the sucking tube to a can.

With reference to FIG. 9, the enclosure, denoted with the reference numeral 20, is comprised of an annular member provided with an outer lip 21, an intermediate lip 22 and an internal lip or inner lip 23. The lip 21 is associable at the bottom by snap connection to the peripheral edge defined between the can proper and the closure member 24 fold seamed thereto. The intermediate lip 22 and inner lip 23 define therebetween an annular chamber 25 whereto the tube 1 is associable which is arranged wound along a circumference and inserted within a protective sleeve 26.

Figure 10:
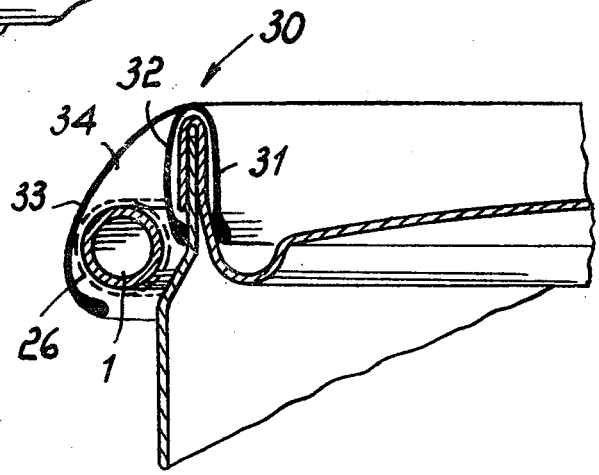
FIG. 10 shows another embodiment of the enclosure for the application of the sucking tube to a can.

FIG. 10 shows an embodiment of the enclosure, denoted with the numeral 30, which has an annular body provided with an inner edge 31, an intermediate edge 32 and an outer edge 33. The inner edge 31 and intermediate edge 32 cooperate in defining therebetween what is in practice a nip member permitting a snap-on engagement of the enclosure 30 with the edge provided at the can base, while the intermediate edge 32 and outer edge 33 define in cooperation therebetween an annular seat 34 whereinto a tube 1 may be inserted as wound in the cited sleeve 26; it will be noted that in this case the tube is arranged externally to the can and peripherally thereto.

Figure 11:
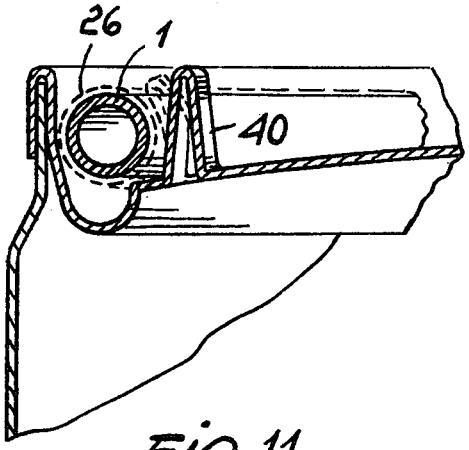
FIG. 11 is a sectional view of a further embodiment of the sucking tube application to a can.
Figure 12:
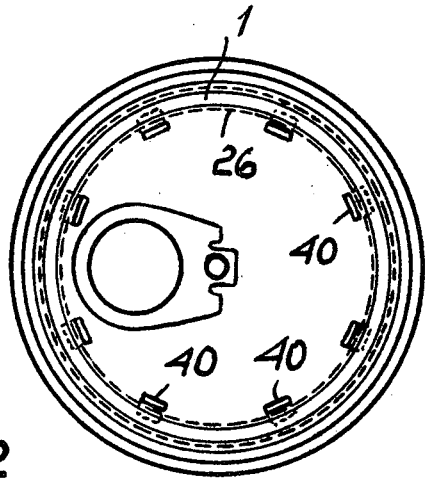
FIG. 12 is a top plan view of the sucking tube shown in FIG. 11.

With reference to FIGS. 11 and 12, the tube is installed by means of a plurality of projections 40 pressure formed in the bottom fold seamed to the can body and defining in cooperation with the can upper edge what is practically an annular channel whereinto the tube 1 is introduced; thereafter the projections 40 are squeezed radially outwards such as to lock the tube 1 contained in its sleeve 26. It should be noted that the distance between the projections 40 is such that at least one finger may be inserted therebetween so as to withdraw the tube from the channel defined by said projections when the tube is to be utilized.

According to a further embodiment, the sucking tube may be associated, through the use of automatic machinery, directly with the lateral outer surface of the can and retained by means of an adhesive tape length or the like which covers and seals off and compresses the flexible hose length making up the sucking tube, the tube being wound about the outer toroidal circumference of the can preferably located at an area directly below the seam line of the can bottom with the can body.

As mentioned above, the sucking tube is of a flexible plastic material, i.e. such as to resiliently deform and return to a substantially linear shape after its withdrawal from the enclosure, and the enclosure is of a heat sealed plastic material such that it may be heat sealed by heat application when mounted to a can, whereas when mounted to the neck of a small bottle it is simply indented by punching to form triangular tabs which allow the tube to be associated with its enclosure to the bottle neck.

In the case of a small bottle type of application, the disc-like area of the doughnut enclosure 2 opens up and diverges at the moment the enclosure 2 is inserted in the bottle neck, thus remaining clamped between the lower edge of the crimped cap and the widening portion underlaying it in the bottle neck (FIG. 1).

In the case of a can type of application, of the tear-off closure design, the tube 1 in its enclosure is attached by heat sealing or glueing, or possibly by snap-on engagement as described above, to either base of the container.

The invention as such is susceptible to many modifications and variations, all of which fall within the scope of the present inventive concept.

I claim:

1. A sucking tube assembly in combination with a can, comprising an enclosure removably connected to the can and containing a sucking tube wound up within said enclosure, characterized in that said enclosure comprises an annular body having an inner lip, an intermediate lip and an outer lip, said outer lip being engaged over the connection area between the can body and the can bottom closure, said intermediate lip and inner lip defining in cooperation an annular chamber with said sucking tube housed therein.

* * * * *